United States Patent [19]

Pizzio

[11] 4,082,557

[45] Apr. 4, 1978

[54] SILVER BASE ACTIVATING SOLUTIONS FOR ELECTROLESS COPPER DEPOSITION

[75] Inventor: Pietro Pizzio, Turin, Italy

[73] Assignee: Alfachimici S.p.A., Turin, Italy

[21] Appl. No.: 706,595

[22] Filed: Jul. 19, 1976

[30] Foreign Application Priority Data

Jul. 25, 1975 Italy ..... 68938 A/75

[51] Int. Cl.[2] ..... C23C 3/02

[52] U.S. Cl. ..... 106/1.11; 427/304; 427/306; 423/279; 423/593; 423/602

[58] Field of Search ..... 427/383 B, 226, 125, 427/372 R; 252/456; 204/46 A; 424/132, 290, 317; 106/1; 96/114.6; 423/279, 326, 593, 602, 604

[56] References Cited

U.S. PATENT DOCUMENTS

| | | | |
|---|---|---|---|
| 2,630,444 | 3/1953 | Fugassi et al. | 96/114.6 |
| 2,785,106 | 3/1957 | Mendelsohn | 424/132 X |
| 3,093,509 | 6/1963 | Wein | 427/98 |
| 3,122,449 | 2/1964 | Swanson | 427/98 X |

*Primary Examiner*—Ralph S. Kendall

*Attorney, Agent, or Firm*—Young & Thompson

[57] ABSTRACT

A silver base activating solution, for use prior to electroless copper deposition, contains a salt of a weak oxyacid of an element of group III, IV, V or VI of the periodic system, e.g. sodium tetraborate. A relatively low silver concentration, within the range of 0.01 g/l to 1 g/l can accordingly be used; and the resulting copper coating forms quickly and is compact, smooth and adherent. The silver solution is stable.

8 Claims, No Drawings

SILVER BASE ACTIVATING SOLUTIONS FOR ELECTROLESS COPPER DEPOSITION

The present invention relates to the activating or catalytic solutions that are used to pre-condition the surface of a workpiece that is subsequently to be coated with copper by electroless deposition, more particularly such solutions in which the activating metal is silver.

Electroless deposition processes are, as is well known, of a non-galvanic type, in which a metal is deposited on a workpiece without the use of an electric current. The workpiece to be coated accordingly does not have to be electroconductive, and such processes are often used in the metal coating of non-conductive workpieces in order to provide a thin metallic coating on their surface. Such a coating is commonly copper or nickel, which, because they are electrically conductive, can enable the subsequent finishing of the workpiece with an electrolytic process.

Such electroless deposition processes are often used for metallizing a plastic article, for ornamentation or for the provision of a prime coat, or in the formation of printed electric circuits.

Typically, such electroless deposition comprises four basic operations, as follows:

1. Mordanting, in which the articles to be metal coated are treated with chromic sulphate solutions in order to render their surfaces wettable and microporous. The mordanted pieces are subsequently washed.

2. Sensitization, in which the pieces are immersed in a solution of stannous chloride and hydrochloric acid, so that small quantities of stannous chloride are deposited in the pores formed by the mordanting. The treated pieces are then washed again.

3. Activation or catalyzation, in which the workpieces are immersed in a solution of a noble metal, small quantities of which in reduced form due to the stannous chloride become affixed to the surface of the workpieces. The workpieces are thereafter washed again.

4. Metal coating, during which the pieces are immersed in a solution comprising, among other things, a soluble metal to be electrolessly deposited and a reducing agent. The particles of noble metal, which were deposited on the surface of the workpieces during activation, catalyze the initiation of the reduction reaction of the metallic ions contained in the solution; and the reaction which is thus activated then proceeds autocatalytically until a thin metallic coating is formed.

Such a metallic coating should be compact and homogeneous, to insure uniform electrical conduction in subsequent electrolytic treatments and to provide smooth surfaces without pinholes or flaws. The metallic coating should also adhere firmly to the substrate and in particular should be resistant to wear and should be strongly adherent without stripping off or forming blisters or cracks.

Noble metals used for activation can, for example, be gold, silver, platinum or palladium. Palladium is ordinarily preferred, particularly because of its good catalytic properties and because it permits activation in a single step in which the stannous chloride solution and the palladium chloride solution are used together.

However, the use of palladium as the activating metal is not economical. The cost of palladium is very high, about the cost of gold, and so palladium activating solutions are quite expensive.

Attempts have been made to find an activating metal less costly than gold or palladium, but until the present invention, no industrially significant results were produced.

It is known that the electroless deposition of copper, as distinct from that of nickel, can be activated or catalyzed by silver, whose cost is much lower than that of palladium. Until now, however, silver has not found practical application in this field, because great quantities of it are consumed in the process. This is principally because the known silver activating solutions rapidly deteriorate. Indeed, when the workpiece is sensitized with stannous chloride and then activated with silver nitrate, the chloride causes the precipitation of silver chloride and portions of the reduced silver precipitate in the metallic state without becoming fixed to the sensitized surface. The bath is thus prematurely depleted and the ultimate metallization has poor adherence and is irregular. The silver also precipitates on the bottom of the tank and triggers the decomposition of the coating bath.

Attempts have been made to overcome these drawbacks of silver base activation solutions, by adding ammonium hydroxide to them which forms a silver ammonium complex and impedes the precipitation of the silver chloride. However, metallic precipitates still form, with consequent difficulties; and moreover, as the silver ammonium complex is less active than the free silver ions, it is necessary to use more concentrated solutions, which in certain processes can involve the use of as much as 10 g/l of silver nitrate. Losses from the solution and deposition on the container are increased, whereby there is an even greater loss of silver. Moreover, such solutions with high silver content also suffer greater silver losses than less concentrated solutions, because the silver salts are even more subject to reduction by light rays.

Until now, silver base activating solutions have not been useful in the treatment of workpieces which are already partially of copper, as for example for the copper coating of contact holes of printed circuits. In this case, the silver, which is more noble than copper, is deposited as a powder on the already coated parts, thereby depleting the bath and causing imperfections of the metal coating.

Accordingly, it is an object of the present invention to provide a silver base activating solution which is substantially free from the drawbacks referred to, and thus leads to an advantageous use of silver as an activator or catalyst in electroless metal coating, thereby reducing the cost of electroless coating without impairing the quality of the product.

This object is achieved, according to the present invention, in that the silver base activating solution contains at least one salt of at least one weak oxyacid of an element of the III, IV, V or VI group of the periodic system of the elements.

Among the weak oxiacids of elements of the III, IV, V or VI group of the periodic system of the elements, applicable in this invention, can be enumerated for example boric acid, formic acid, silicic acid, vanadic acid, arsenic acid, molybdic acid, and wolframic acid.

Preferably the anions of weak oxiacid or oxiacids of an element or of elements selected from the group consisting of Groups III, IV, V and VI of the periodic system of the elements is present in aqueous solution in conditions of use in such a concentration that the solution has a pH not less than 7.3.

In a first embodiment of the invention, the activating solution comprises a silver salt, for example silver nitrate, and at least one alkali metal salt of a weak oxyacid of the type described above. In a second embodiment of the invention, the activating solution is formed principally of a silver salt of at least one weak oxyacid of the type described above.

In both cases, these salts of weak oxyacids are basic in nature and their use produces a rise in pH, with the formation of silver alkaline solutions, by which the catalytic power of silver is enhanced.

The invention also comprises a process of electroless deposition involving the use of such an activating solution.

Thus it is a feature of the present invention to provide an alkaline silver base activating solution of enhanced catalytic property, that does not have the above-identified drawbacks.

The present invention can be practiced either with the use of a salt of an oxyacid of a semi-metallic element, such as boron or silicon, or with the use of a salt of an oxyacid of an element of more metallic nature, such as tungsten. However, the silver salts of these various oxyacids, which are the reaction products of the alkali salts of these with the silver salts, have various solubilities and various catalytic effectiveness. In view of these variations, therefore, it is preferable in general to use boron salts, such as sodium tetraborate. The use of this salt in fact provides an activating solution in which the silver content and the alkali salt content can vary within broad ranges without either precipitation or decrease of activity. The use of a silver borate solution has analogous advantages.

In contrast to the known procedures, the activating solutions according to the present invention do not require any special technique for their preparation, it being sufficient merely to admix the various components at ambient temperature and with stirring, bearing in mind only that precipitation may occur if a high concentration of relatively soluble reagents results in the production of a reaction product of less solubility. Even in this case, however, any such precipitate may be removed by filtration or decantation, and the danger of producing a defective metal coating is thus avoided.

However, when boron salts are used, even this potential danger does not arise; and so it is possible to form, with boron salts, activating solutions in concentrated form that can be diluted for use. For example, a concentrated solution of this sort can contain 1 to 3 g/l of $AgNO_3$ and 0.2 to 20 g/l of $Na_2B_4O_7.10\ H_2O$.

The strong catalytic property of the silver base solutions prepared according to the present invention thus results in effective activation with much lower concentrations of silver than were required in silver base activating solutions that were previously known. These concentrations according to the present invention can be reduced nearly to those of the more costly noble metals used heretofore, without militating against the good results of the subsequent metal coating process that are obtained when the present invention is practiced.

Moreover, the activating solutions according to the present invention can be used in the metal coating of bodies which are already partly metal coated, as for example in the metal coating of the contact holes of printed circuits. Using the solutions of the present invention, the drawbacks of deposition of silver on copper are reduced to the point that they are negligible.

Another advantage of activating solutions according to the present invention is that they are highly stable even when exposed to light.

For example, an activating solution according to the present invention was exposed to full light and air for a period of three months, and no formation of precipitates was observed during that period of time, nor any decrease of activity of the solution.

In order to enable those skilled in this art to practice the invention, the following illustrative example is given:

EXAMPLE

A plate of acrilonitrile-butadiene-styrene (ABS) was mordanted for 10 minutes at 65° C. in an aqueous solution containing 400 g/l of $CrO_3$ and 200 cc/l of $H_2SO_4$. After washing, and without any sensitization treatment, it was immersed in an activating solution according to the invention, prepared in concentrated form, and diluted to the following concentration for use:

| | | |
|---|---|---|
| Silver nitrate | 0.125 | g/l |
| Sodium tetraborate decahydrate | 2.0 | g/l. |

Immersion was continued for 3 minutes, and then the plate was removed and washed and immersed in an electroless copper base metal coating solution having the following composition:

| | |
|---|---|
| Copper sulfate pentahydrate | 12 g/l |
| Rochelle salt | 25 g/l |
| 40% formaldehyde | 20 cc |
| Sodium hydroxide | 14 g/l |

at a temperature of 25° C. Immediately after immersion, the plate displayed a uniform change of color; and after 5 minutes immersion, its surface was completely covered with a coating of compact, smooth and strongly adherent metallic copper.

At the same time, for comparison, tests were conducted using known activating solutions, of the same silver concentration as above. With silver nitrate solutions, traces of metal coating were observed only after 10 minutes and only in some areas of the plate. With the use of ammonium solutions, no sign of metal coating could be noted even after a longer time.

The above test results are especially significant if it is recognized that the silver concentrations used are only about 1/50 of the normal concentration used in activations with silver according to the prior art. Moreover, it should also be borne in mind that the example given is not the lower limit of silver concentration that is useful according to the present invention: even lower silver concentrations can be used.

The activation performed with solutions according to the present invention has given good results not only as to ABS resin, but also on other plastic materials susceptible of receiving a metal coating by electroless deposition, such as polypropylene, polyvinylchloride, polystyrene, epoxy resins, polysulfonates and phenolic resins. In certain cases, as with phenolic resins and polypropylene, the results were of a high quality difficult to obtain even with the use of a palladium activator. It is known in the art that these latter two plastic materials are particularly difficult to metal coat, since the deposition tends to proceed in a haphazard manner and tends to be incomplete, non-uniform and weakly adherent. But by the use of the activating solutions of the present invention, a rapid, uniform and strongly adherent deposition is obtained on these latter plastic materials.

It is also to be noted that, according to the present invention, a silver base activating solution is obtained which is alkaline in character, and which is obtained without the introduction of an ammonium compound. Thus the intensification of the catalytic property of the silver which is obtained by the use of a salt of at least one weak oxyacid of an element of the III, IV, V or VI group of the periodic system of the elements, can be attained without the necessary addition of further components to the activation solution.

It will also be appreciated that a solution according to the present invention can contain salts of more than one such oxyacid, and that these salts can be introduced into the solution in the form of alkali metal salts, or in the form of silver salts, or partly in one form and partly in the other form, alone or in combination with any suitable silver salt and with conventional additives. Thus the particular example given is merely a preferred form and does not define the limits of the invention, reference for this latter purpose being had only to the appended claims.

From a consideration of the foregoing disclosure, therefore, it will be evident that the initially recited object of the present invention has been achieved.

Although the present invention has been described in connection with a preferred embodiment, it is to be understood that modifications and variations may be resorted to without departing from the spirit of the invention as those skilled in this art will readily understand. Such modifications and variations are considered to be within the purview and scope of the present invention a defined by the appended claims.

What I claim is:

1. A silver base activating solution for activating a workpiece for the electroless deposition thereon of copper, consisting essentially of an aqueous solution containing cations of silver and anions of at least one weak oxyacid selected from the group consisting of boric acid, silicic acid, vanadic acid, arsenic acid, molybdic acid, and wolframic acid, the silver concentrations being from 0.01 g/l to 1 g/l, and the acid concentration being such that the pH of the solution is not less than 7.3, with reference to the activating solution in conditions of use.

2. Activating solution as claimed in claim 1, containing at least one silver salt and at least one alkali salt of at least one said oxyacid.

3. Activating solution as claimed in claim 1, containing at least one silver salt of at least one said oxyacid.

4. Activating solution as claimed in claim 1, containing at least one silver salt of at least one said oxyacid and at least one alkali salt of at least one said oxyacid.

5. Activating solution as claimed in claim 1, containing at least one silver salt and at least one silver salt of at least one said oxyacid.

6. Activating solution as claimed in claim 1, in which said oxyacid is boric acid.

7. An activating solution as claimed in claim 1, in concentrated form for dilution prior to use, containing 1 to 3 g/l of $AgNO_3$ and 0.2 to 20 g/l of $Na_2B_4O_7.10\ H_2O$.

8. An activating solution as claimed in claim 1, containing about 0.125 g/l of silver nitrate and about 2 g/l of sodium tetraborate decahydrate.

* * * * *